US005825236A

United States Patent [19]

Seevinck et al.

[11] Patent Number: 5,825,236

[45] Date of Patent: Oct. 20, 1998

[54] LOW VOLTAGE BIAS CIRCUIT FOR GENERATING SUPPLY-INDEPENDENT BIAS VOLTAGES CURRENTS

[75] Inventors: Evert Seevinck, Eersel, Netherlands; Monuko Du Plessis, Pretoria, South Africa

[73] Assignee: U.S. Philips Corporation, New York, N.Y.

[21] Appl. No.: 859,798

[22] Filed: May 19, 1997

[30] Foreign Application Priority Data

May 22, 1996 [EP] European Pat. Off. ..... 96201415

[51] Int. Cl.[6] ..... G05F 1/10

[52] U.S. Cl. ..... 327/538; 327/543

[58] Field of Search ..... 327/530, 534, 327/535, 537, 538, 542; 323/312, 313, 315

[56] References Cited

U.S. PATENT DOCUMENTS 5,216,291 6/1993 Seevinck et al. ..... 307/296.6

OTHER PUBLICATIONS

P.R. Gray and R.G. Meyer, Analysis and Design of Analog Integrated Circuits, Second Edition, Wiley, New York, 1984, Fig. 4.24A.

*Primary Examiner*—Toan Tran
*Assistant Examiner*—Jeffrey Zweizig
*Attorney, Agent, or Firm*—Steven R. Biren

[57] ABSTRACT

A CMOS bias circuit capable of operating down to a supply voltage equal to the sum of the threshold voltage and the saturation voltage. It generates a threshold referenced bias voltage which is independent of the supply voltage. This bias voltage is equal to the gate source voltage of a transistor which supplies a current equal to the gate-source voltage of another transistor divided by the resistance of a feedback resistor. Via the feedback resistor, changes in the supply voltage cause counteracting changes in the gate-source voltages of the transistors, resulting in a bias voltage which is substantially constant with changing supply voltage.

20 Claims, 1 Drawing Sheet

LOW VOLTAGE BIAS CIRCUIT FOR GENERATING SUPPLY-INDEPENDENT BIAS VOLTAGES CURRENTS

BACKGROUND OF THE INVENTION

1. Field of the Invention

The invention relates to bias circuits for generating bias voltages and currents. Such a bias circuit can be used, for example, in mixed-mode CMOS integrated circuits in which analog and digital circuits are integrated on the same semiconductor body.

2. Discussion of Related Art

For future portable systems the circuits have to operate down to supply voltages just exceeding the threshold voltage of the MOS transistors. A key building block needed in such circuits is a bias circuit providing supply-independent bias voltages and currents. In addition, high-frequency supply interference, generally caused by the digital part of the circuit, has to be rejected to enable good-quality performance of the analog part.

FIG. 1 shows a threshold-referenced bias circuit known from P. R. Gray and R. G. Meyer, Analysis and design of analog integrated circuits, Second Edition, Wiley, New York, 1984, FIG. 4.24a. It is not suitable for low supply voltage however, since it includes two stacked gate-source voltage drops of the transistors $P_A$ and $N_A$, and a drain-source saturation voltage of transistor $N_B$. Also this known bias circuit is not well-regulated against supply variations.

SUMMARY OF THE INVENTION

It is an object of the invention to provide a bias circuit capable of generating supply-independent bias voltages and currents down to a low supply voltage.

According to the invention there is provided a bias circuit comprising:

- a first supply terminal, a second supply terminal, and a bias voltage terminal;
- a first current mirror comprising first and second transistors of a first conductivity type, having a current input terminal, a current output terminal coupled to the bias voltage terminal, and a common terminal coupled to the second supply terminal;
- a second current mirror comprising third and fourth transistors of a second conductivity type opposite to the first conductivity type, having a current input terminal, a current output terminal coupled to the current output terminal of the first current mirror and to the bias voltage terminal, and a common terminal coupled to the first supply terminal;
- current providing means coupled between the first supply terminal and the current input terminal of the first current mirror for providing a current to the input terminal of the first current mirror;
- a fifth transistor of the first conductivity type having a gate, a source coupled to the second supply terminal, and a drain coupled to the current input terminal of the second current mirror;
- resistive means coupled in parallel to the gate and the source of the fifth transistor; and
- a sixth transistor of the second conductivity type, having a gate coupled to the bias voltage terminal, a source coupled to the first supply terminal, and a drain coupled to the gate of the fifth transistor.

The bias circuit according to the invention operates down to a supply voltage equal to the sum of the threshold voltage and the saturation voltage. It generates a supply-independent threshold-referenced bias voltage relative to the first supply terminal, similar as the known bias circuit depicted in FIG. 1. This bias voltage is equal to the gate-source voltage of the sixth transistor needed for a current having a value equal to the threshold voltage of the fifth transistor divided by the resistance of the resistive means. Changes in the supply voltage cause corresponding changes in the gate-source voltage of the fifth transistor. Therefore the current through the resistive means and the sixth transistor will change proportionally causing a change in the gate-source voltage of the sixth transistor and the bias voltage. This change is counteracted by a change in drain current of the sixth transistor owing to the channel-shortening effect of the sixth transistor. The net result is a bias voltage which is substantially constant with changing supply voltage.

The bias circuit may further comprise a seventh transistor of the second conductivity type, having a gate coupled to the bias voltage terminal, a source coupled to the first supply terminal, and a drain coupled to the drain of the fifth transistor. The seventh transistor may be added to provide a slight amount of positive feedback in order to increase the current of the fifth transistor for very low supply voltage and to maintain a constant bias voltage.

BRIEF DESCRIPTION OF THE DRAWINGS

These and other aspects of the invention will be elucidated and described with reference to the accompanying drawing in which.

In these Figures the same or similar elements have the same reference signs.

DESCRIPTION OF THE PREFERRED EMBODIMENTS

Figure 1:
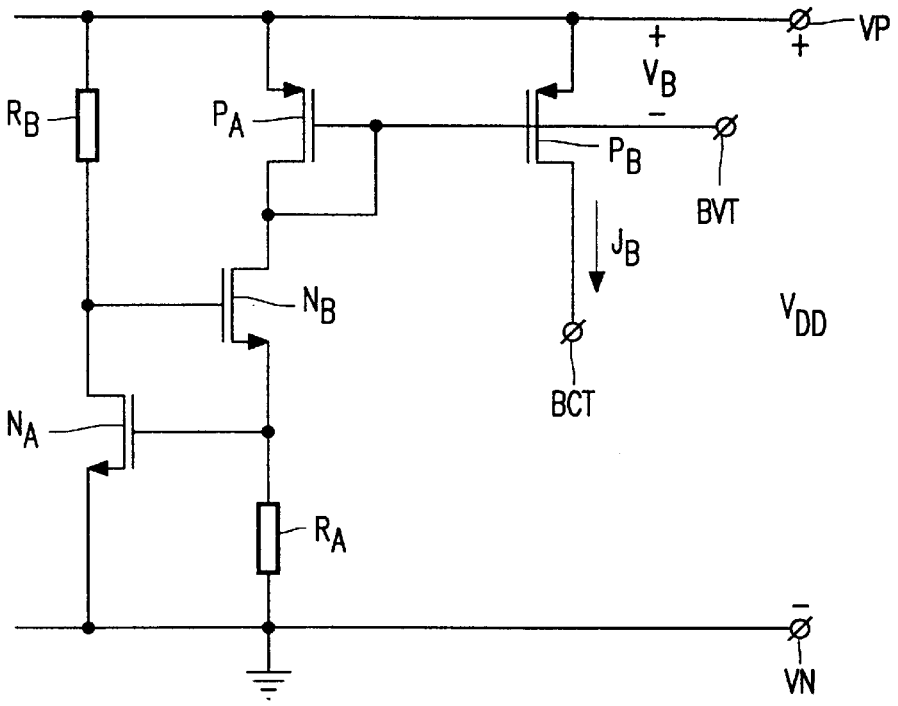
PRIOR ART FIG. 1
FIG. 1 shows a circuit diagram of a conventional bias circuit.

FIG. 1 shows a conventional bias circuit. A supply voltage $V_{DD}$ is connected between a positive supply terminal VP and a negative supply terminal VN which serves as signal ground. The source of a PMOS transistor $P_A$ is connected to the positive supply terminal VP, whereas the interconnected gate and drain of transistor $P_A$ are connected to a bias voltage terminal BVT. The bias voltage $V_B$ is therefore equal to the gate-source voltage of transistor $P_A$. The current supplied by resistor $R_B$ is forced to flow in transistor $N_A$. and, in order for this to occur, the transistor $N_B$ must supply enough current into resistor $R_A$ so that the gate-source voltage of transistor $N_A$ is adapted to the current supplied by resistor $R_B$. The current through transistor $P_A$ is equal to the current flowing through resistor $R_A$ which is proportional to the gate-source voltage of transistor $N_A$. The bias voltage circuit thus generates a threshold-referenced bias voltage $V_B$ relative to the supply voltage $V_{DD}$. The current through transistor $P_A$ is determined by the loop comprising the NMOS transistors $N_A$ and $N_B$, and the resistors $R_A$ and $R_B$. Scaled copies of the current through transistor $P_A$ may be obtained by means of one or more PMOS transistors $P_B$ with a source, gate and drain connected to, respectively, the positive supply terminal VP, the bias voltage terminal BVT and an bias current terminal BCT. The lowest possible supply voltage $V_{DD}$ is equal to the sum of the gate-source voltages of the transistors $N_A$ and $P_A$ and the drain-source saturation voltage of transistor $N_B$. An increasing supply voltage $V_{DD}$ causes an increasing current through transistor $N_A$ and an increasing voltage over resistor $R_A$ . This in turn causes an increasing current through transistor $P_A$ and an increasing bias voltage $V_B$. The bias circuit of FIG. 1 is therefore not well-regulated against supply voltage variations.

Figure 2:
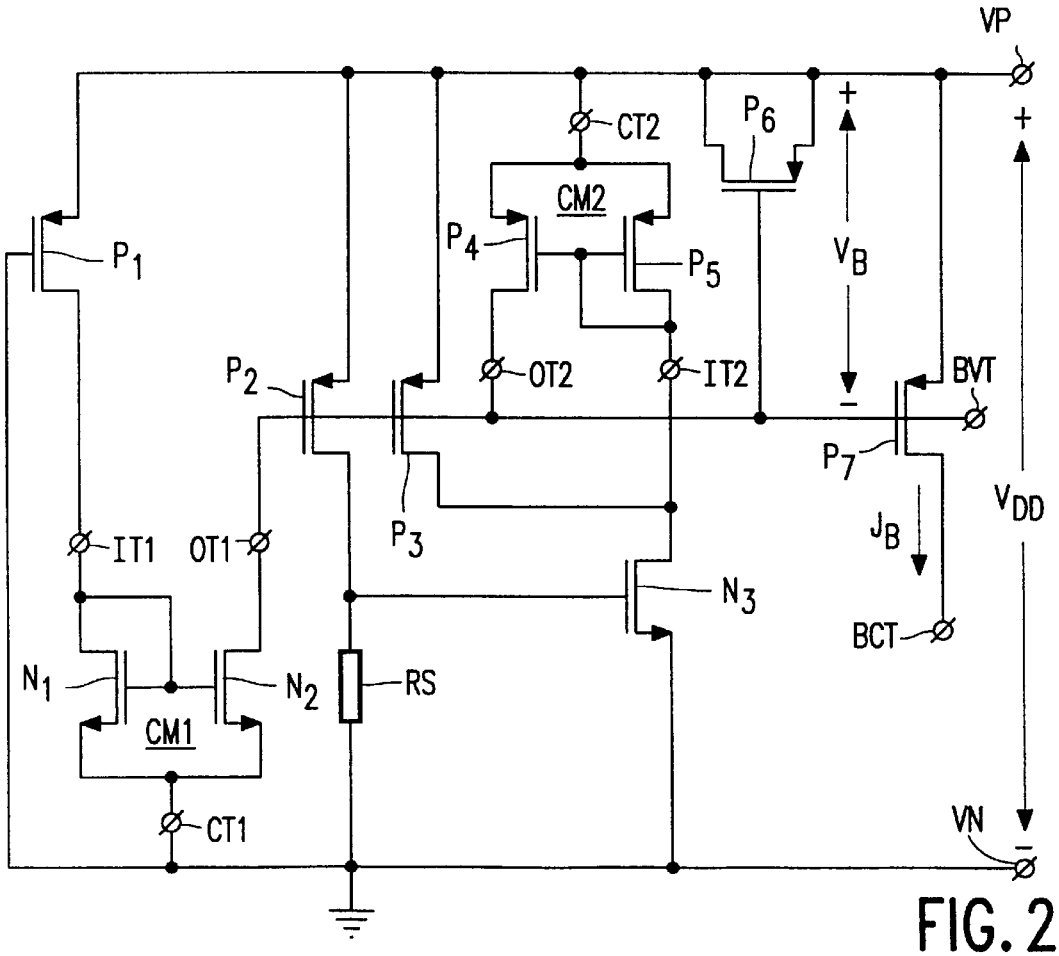
FIG. 2 shows a circuit diagram of a bias circuit according to the invention.

FIG. 2 shows a bias circuit according to the invention. The bias circuit comprises a first current mirror CM1 having a current input terminal IT1, a current output terminal OT1 coupled to the bias voltage terminal BVT, and a common terminal coupled to the second supply terminal VN; and a second current mirror CM2 having a current input terminal IT2, a current output terminal coupled to the current output terminal OT1 of the first current mirror CM1 and to the bias voltage terminal BVT, and a common terminal CT2 coupled to the first supply terminal VP. The current input terminal IT1 of current mirror CM1 is coupled to the drain of a PMOS transistor $P_1$, the source of which is connected to the positive supply terminal VP and the gate of which is connected to the negative supply terminal VN. The transistor $P_1$ provides a current to the current mirror CM1. The transistor $P_1$ may be replaced by a resistor. The current input terminal IT2 of current mirror CM2 is coupled to the drain of a NMOS transistor $N_3$, the source of which is coupled to the negative supply terminal VN. A resistor RS is connected between the gate and the source of transistor $N_3$.

The bias circuit further comprises a PMOS transistor $P_2$, with a gate coupled to the bias voltage terminal BVT, a source coupled to the first supply terminal VP, and a drain coupled to the gate of transistor $N_3$, an optional PMOS transistor $P_3$ with a gate coupled to the bias voltage terminal BVT, a source coupled to the first supply terminal VP, and a drain coupled to the drain of transistor $N_3$, an optional PMOS transistor $P_6$ with a gate coupled to the bias voltage terminal BVT and a source and drain coupled to the positive supply terminal VP, and one or more optional PMOS transistors $P_7$ with a gate coupled to the bias voltage terminal BVT, a source coupled to the first supply terminal VP, and a drain coupled to the bias current terminal BCT.

The current mirror CM1 is implemented with NMOS transistors $N_1$ and $N_2$. The sources of transistors $N_1$ and $N_2$ are connected to the common terminal CT1. The gates of the transistors $N_1$ and $N_2$ are interconnected and also connected to the drain of transistor $N_1$. The drain of transistor $N_1$ is connected to the current input terminal IT1 and the drain of transistor $N_2$is connected to the current output terminal OT1. Current mirror CM2 is implemented with PMOS transistors $P_5$ and $P_4$ which are connected to the current input terminal IT2, current output terminal OT2 and common terminal CT2 in a fashion similar to the transistors $N_1$ and $N_2$.

As can be seen from FIG. 2 the bias circuit operates down to a supply voltage $V_{DD}$ equal to the sum of a threshold voltage Vt of transistor $P_2$ and a drain-source saturation voltage $V_{DS\ sat}$ of transistor $N_2$. However, when minimum supply voltage is of less concern more sophisticated current mirror configuration may be employed, for instance cascoded current mirrors or Wilson current mirrors.

The bias circuit operates as follows. First the transistors $P_3$ and $P_6$ are ignored. Transistor $P_1$ is a weak transistor, i.e. a transistor with a small width over length ratio (W/L) and small transconductance factor, in saturation. The current of transistor $P_1$ is attenuated by the mirror-ratio of current mirror CM1 and forced to flow in transistor $P_4$ by the negative feedback loop consisting of transistors $P_2$, $N_3$, $P_5$ and $P_4$. Since transistors $P_4$ and $P_5$ form a current mirror, the current of transistor $N_3$ is proportional of that of transistor $P_1$. Transistor $N_3$ is chosen strong, i.e. a transistor with a large W/L, in order that its gate-source voltage is slightly higher than the threshold voltage Vt. Therefore the current of transistor $P_2$ is approximately equal to Vt/R, R being the resistance of resistor RS. The bias voltage $V_B$ is therefore equal to the gate-source voltage of transistor $P_2$ needed for a current of Vt/R through transistor $P_2$. The bias current $I_B$ supplied by optional transistor $P_7$ will be proportional to Vt/R.

The effect of supply-voltage variations is twofold. Suppose the supply voltage $V_{DD}$ increases. First, since the currents of the transistors $N_3$ and $P_1$ are proportional and both transistors are saturated, the gate-source voltage of transistor $N_3$ will increase proportional to the increase in the supply voltage $V_{DD}$. Therefore the current through resistor RS will also increase proportionally. Second, the source-drain voltage of transistor $P_2$ increases with the supply voltage $V_{DD}$. Therefore, owing to the channel-shortening effect, its drain current will increase proportional to the increase in the supply voltage $V_{DD}$. By designing the bias circuit such that the increase in current through resistor RS is provided by the increase in the current of transistor $P_2$ owing to channel shortening, it can be achieved that the bias voltage $V_B$ will remain constant with changing supply voltage $V_{DD}$.

Transistor $P_3$, which is very weak, may be added to provide a slight amount of positive feedback. This is only relevant for very low supply voltages to increase the current of transistor $N_3$ and thus to maintain a constant value for the bias voltage $V_B$. If transistor $P_3$ is too strong, unwanted hysteresis can result.

Transistor $P_6$ acts as a compensation capacitor to stabilize the aforementioned negative feedback loop of transistors $P_2$, $N_3$, $P_5$ and $P_4$. Transistor $P_6$ can be replaced with a capacitor connected between the positive supply terminal VP and the bias voltage terminal BVT. In applications where large or many transistors such as transistor $P_7$ are biased, transistor $P_6$ can be omitted since sufficient capacitance will then be present. An advantage of compensating in this way, rather than via the Miller-effect of a capacitor between the bias voltage terminal BVT and the gate of transistor $N_3$, is that high-frequency interference on the positive supply terminal VP is rejected when generating $V_B$.

By replacing PMOS transistors by NMOS transistors and vice versa a bias circuit is obtained which generates a bias voltage relative to ground. The bias circuit of FIG. 2 was designed for fabrication in a 1.2$\mu$ n-well digital CMOS process with a threshold voltage Vt of about 0.9 V for both N and P devices. The design details are given in Table 1. W and L denote the width and length of the transistor. Resistor RS was a n-well resistor with resistance R=80 kΩ.

| Transistor | W ($\mu$m) | L ($\mu$m) |
|---|---|---|
| $P_1$ | 3.6 | 100 |
| $P_2$ | 180 | 5 |
| $P_3$ | 3.6 | 100 |
| $P_4$ | 3.6 | 5 |
| $P_5$ | 3.6 | 5 |
| $P_6$ | 60 | 30 |
| $N_1$ | 72 | 2.4 |
| $N_2$ | 3.6 | 2.4 |
| $N_3$ | 3.6 | 5 |

The measured bias voltage $V_B$ was 1.123 V, varying by 9 mV from $V_{DD}$=1.130 V to $V_{DD}$=5 V. Regulation is maintained down to a supply voltage only 7 mV higher than the bias voltage $V_B$ and 220 mV higher than the threshold voltage Vt. This performance is the result of the conductance cancelling through the channel-shortening effect in transistor $P_2$ and the positive feedback provided by transistor $P_3$.

We claim:

1. A bias circuit comprising:

a first supply terminal (VP), a second supply terminal (VN), and a bias voltage terminal (BVT);

a first current mirror (CM1) comprising first ($N_1$) and second ($N_2$) transistors of a first conductivity type, having a current input terminal (IT1), a current output terminal (OT1) coupled to the bias voltage terminal (BVT), and a common terminal (CT1) coupled to the second supply terminal (VN);

a second current mirror (CM2) comprising third ($P_4$) and fourth ($P_5$) transistors of a second conductivity type opposite to the first conductivity type, having a current input terminal (IT2), a current output terminal (OT2) coupled to the current output terminal (OT1) of the first current mirror (CM1) and to the bias voltage terminal (BVT), and a common terminal (CT2) coupled to the first supply terminal (VP);

current providing means ($P_1$) coupled between the first supply terminal (VP) and the current input terminal (IT1) of the first current mirror (CM1) for providing a current to the input terminal (IT1) of the first current mirror (CM1), a fifth transistor ($N_3$) of the first conductivity type having a gate, a source coupled to the second supply terminal (VN), and a drain coupled to the current input terminal (IT2) of the second current mirror (CM2);

resistive means (RS) coupled in parallel to the gate and the source of the fifth transistor ($N_3$); and a sixth transistor ($P_2$) of the second conductivity type, having a gate coupled to the bias voltage terminal (BVT), a source coupled to the first supply terminal (VP), and a drain coupled to the gate of the fifth transistor ($N_3$).

2. A bias circuit as claimed in claim 1, further comprising a seventh transistor ($P_3$) of the second conductivity type, having a gate coupled to the bias voltage terminal (BVT), a source coupled to the first supply terminal (VP), and a drain coupled to the drain of the fifth transistor ($N_3$).

3. A bias circuit as claimed in claim 2, further comprising capacitive means ($P_6$) coupled between the first supply terminal (VP) and the bias voltage terminal (BVT).

4. A bias circuit as claimed in claim 3, wherein the capacitive means comprises an eighth transistor ($P_6$ ) of the second conductivity type, having a gate coupled to the bias voltage terminal (BVT), and having source and drain connected to the first supply terminal (VP).

5. A bias circuit as claimed in claim 2, further comprising a ninth transistor ($P_7$) of the second conductivity type, having a gate, a source and a drain coupled to, respectively, the bias voltage terminal (BVT), the first supply terminal (VP) and a bias current terminal (BCT).

6. A bias circuit as claimed in claim 2, wherein respective sources of the first ($N_1$) and second ($N_2$) transistors are coupled to the common terminal (CT1) of the first current mirror (CM1), respective gates of the first ($N_1$) and second ($N_2$) transistors are coupled to a drain of the first transistor ($N_1$), the drain of the first transistor ($N_1$) is coupled to the current input terminal (IT1) of the first current mirror (CM1), and a drain of the second transistor ($N_2$) is coupled to the current output terminal (OT1) of the first current mirror (OT1).

7. A bias circuit as claimed in claim 1, further comprising capacitive means ($P_6$) coupled between the first supply terminal (VP) and the bias voltage terminal (BVT).

8. A bias circuit as claimed in claim 7, wherein the capacitive means comprises an eighth transistor ($P_6$) of the second conductivity type, having a gate coupled to the bias voltage terminal (BVT), and having source and drain connected to the first supply terminal (VP).

9. A bias circuit as claimed in claim 8, further comprising a ninth transistor ($P_7$) of the second conductivity type, having a gate, a source and a drain coupled to, respectively, the bias voltage terminal (BVT), the first supply terminal (VP) and a bias current terminal (BCT).

10. A bias circuit as claimed in claim 8, wherein respective sources of the first ($N_1$) and second ($N_2$) transistors are coupled to the common terminal (CT1) of the first current mirror (CM1), respective gates of the first ($N_1$) and second ($N_2$) transistors are coupled to a drain of the first transistor ($N_1$), the drain of the first transistor ($N_1$) is coupled to the current input terminal (IT1) of the first current mirror (CM1), and a drain of the second transistor ($N_2$) is coupled to the current output terminal (OT1) of the first current mirror (OT1).

11. A bias circuit as claimed in claim 7, wherein respective sources of the third ($P_4$) and fourth ($P_5$) transistors are coupled to the common terminal (CT2) of the second current mirror (CM2), respective gates of the third ($P_4$) and fourth ($P_5$) transistors are coupled to a drain of the fourth transistor ($P_5$) , the drain of the fourth transistor ($P_5$) is coupled to the current input terminal (IT2) of the second current mirror CM2), and a drain of the third transistor ($P_4$) is coupled to the current output terminal (OT2) of the second current mirror (CM2).

12. A bias circuit as claimed in claim 1, further comprising a ninth transistor ($P_7$) of the second conductivity type, having a gate, a source and a drain coupled to, respectively, the bias voltage terminal (BVT), the first supply terminal (VP) and a bias current terminal (BCT).

13. A bias circuit as claimed in claim 12, wherein the current providing means comprises a tenth transistor ($P_1$) of the second conductivity type having a gate, a source and a drain coupled to, respectively, the second supply terminal (VN), the first supply terminal (VP) and the current input terminal (IT1) of the first current mirror (CM1).

14. A bias circuit as claimed in claim 13, wherein respective sources of the third ($P_4$) and fourth ($P_5$) transistors are coupled to the common terminal (CT2) of the second current mirror (CM2), respective gates of the third ($P_4$) and fourth ($P_5$) transistors are coupled to a drain of the fourth transistor ($P_5$), the drain of the fourth transistor ($P_5$) is coupled to the current input terminal (IT2) of the second current mirror CM2), and a drain of the third transistor ($P_4$) is coupled to the current output terminal (OT2) of the second current mirror (CM2).

15. A bias circuit as claimed in claim 12, wherein respective sources of the third ($P_4$) and fourth ($P_5$) transistors are coupled to the common terminal (CT2) of the second current mirror (CM2), respective gates of the third ($P_4$) and fourth ($P_5$) transistors are coupled to a drain of the fourth transistor ($P_5$), the drain of the fourth transistor ($P_5$) is coupled to the current input terminal (IT2) of the second current mirror CM2), and a drain of the third transistor ($P_4$) is coupled to the current output terminal (OT2) of the second current mirror (CM2).

16. A bias circuit as claimed in claim 1, wherein the current providing means comprises a tenth transistor ($P_1$) of the second conductivity type having a gate, a source and a drain coupled to, respectively, the second supply terminal (VN), the first supply terminal (VP) and the current input terminal (IT1) of the first current mirror (CM1).

17. A bias circuit as claimed in claim 16, wherein respective sources of the first ($N_1$) and second ($N_2$) transistors are coupled to the common terminal (CT1) of the first current mirror (CM1), respective gates of the first ($N_1$) and second ($N_2$) transistors are coupled to a drain of the first transistor ($N_1$), the drain of the first transistor ($N_1$) is coupled to the current input terminal (IT1) of the first current mirror (CM1), and a drain of the second transistor ($N_2$) is coupled to the current output terminal (OT1) of the first current mirror (OT1).

18. A bias circuit as claimed in claim 17, wherein respective sources of the third ($P_4$) and fourth ($P_5$) transistors are coupled to the common terminal (CT2) of the second current mirror (CM2), respective gates of the third ($P_4$) and fourth ($P_5$) transistors are coupled to a drain of the fourth transistor ($P_5$), the drain of the fourth transistor ($P_5$) is coupled to the current input terminal (IT2) of the second current mirror CM2), and a drain of the third transistor ($P_4$) is coupled to the current output terminal (OT2) of the second current mirror (CM2).

19. A bias circuit as claimed in claim 1, wherein respective sources of the first ($N_1$) and second ($N_2$) transistors are coupled to the common terminal (CT1) of the first current mirror (CM1), respective gates of the first ($N_1$) and second ($N_2$) transistors are coupled to a drain of the first transistor ($N_1$), the drain of the first transistor ($N_1$) is coupled to the current input terminal (IT1) of the first current mirror (CM1), and a drain of the second transistor ($N_2$) is coupled to the current output terminal (OT1) of the first current mirror (OT1).

20. A bias circuit as claimed in claim 1, wherein respective sources of the third ($P_4$) and fourth ($P_5$) transistors are coupled to the common terminal (CT2) of the second current mirror (CM2), respective gates of the third ($P_4$) and fourth ($P_5$) transistors are coupled to a drain of the fourth transistor ($P_5$), the drain of the fourth transistor ($P_5$) is coupled to the current input terminal (IT2) of the second current mirror CM2), and a drain of the third transistor ($P_4$) is coupled to the current output terminal (OT2) of the second current mirror (CM2).

* * * * *